US007850046B2

(12) United States Patent
Carta

(10) Patent No.: US 7,850,046 B2
(45) Date of Patent: Dec. 14, 2010

(54) NEBULISER MICRO-PUMP

(75) Inventor: Lamberto Carta, Pescara (IT)

(73) Assignee: Emsar S.p.A., San Giovanni Teatino (CH) (IT)

( * ) Notice: Subject to any disclaimer, the term of this patent is extended or adjusted under 35 U.S.C. 154(b) by 466 days.

(21) Appl. No.: 12/093,140

(22) PCT Filed: Nov. 10, 2006

(86) PCT No.: PCT/IT2006/000785

§ 371 (c)(1),
(2), (4) Date: May 9, 2008

(87) PCT Pub. No.: WO2007/054996

PCT Pub. Date: May 18, 2007

(65) Prior Publication Data

US 2008/0251538 A1 Oct. 16, 2008

(30) Foreign Application Priority Data

Nov. 10, 2005 (IT) ..... RM2005A0559

(51) Int. Cl.
*B05B 11/00* (2006.01)

(52) U.S. Cl. ..... 222/153.13; 222/182; 222/321.8; 222/384; 222/402.11; 222/402.13

(58) Field of Classification Search ..... 222/153.11, 222/153.13, 153.14, 182, 321.1, 321.7–321.9, 222/383.1, 383.3, 385, 402.1, 402.11, 402.13, 222/384
See application file for complete search history.

(56) References Cited

U.S. PATENT DOCUMENTS 3,314,576 A * 4/1967 Focht et al. ..... 222/402.13
3,478,935 A * 11/1969 Brooks ..... 222/321.8
3,531,026 A * 9/1970 Venus, Jr. ..... 222/402.11
4,506,805 A * 3/1985 Marcon ..... 222/153.13
4,889,262 A 12/1989 Toms
5,772,080 A * 6/1998 de Pous et al. ..... 222/321.7
7,249,692 B2 * 7/2007 Walters et al. ..... 222/153.11
2006/0113329 A1 * 6/2006 Walters et al. ..... 222/383.1

FOREIGN PATENT DOCUMENTS

| | | | |
|---|---|---|---|
| EP | 1 317 963 A1 | | 6/2003 |
| EP | 1 561 513 A1 | | 8/2005 |
| EP | 1567417 | * | 8/2005 |
| JP | 9-38540 | * | 2/1997 |
| JP | 10-99745 A | | 4/1998 |

* cited by examiner

*Primary Examiner*—J. Casimer Jacyna
(74) *Attorney, Agent, or Firm*—Young & Thompson

(57) ABSTRACT

A nebuliser micro-pump (1) provided with an element (2) for covering and triggering its dispensing push-button (3), has an elongated body (5) with central axis (x), whereon is mounted a dispensing push-button complete with a tube (4) for orienting the spray, rotatable around the axis. The element has a lower fixed half-shell (12) integral with the elongated body and a lower half-shell (17) movable around a hinging axis (y) that is perpendicular to the central axis and offset relative thereto at the opposite side from the tube. The upper half-shell has a protuberance (20) acting on the dispensing push-button in the rotation of the movable half-shell relative to the fixed half-shell according to the arrow (W). The half-shells (12, 17) have respective through openings (15, 23) wherefrom simultaneously projects the tube in two angular positions, one non operative and the other one operative for the micro-pump.

6 Claims, 2 Drawing Sheets

NEBULISER MICRO-PUMP

TECHNICAL FIELD

The present invention relates to a nebuliser micro-pump provided with an element for covering and triggering its dispensing button. In addition to covering the body of the nebuliser micro-pump with an aesthetically satisfying element, said element serves the purpose of transforming the vertical activating motion, generally downwards, of the dispensing button of a micro-pump for bottles, e.g. in the perfumes industry, into a horizontal activating motion, from the exterior towards the axis of the micro-pump, as is the case for lever or trigger nebulisation systems, frequently used in the nebulisation of products for domestic and personal care.

BACKGROUND ART

A sprayer device of the prior art is described in the U.S. Pat. No. 3,478,935 granted on 18 Nov. 1969 to Brooks. Said device does not serve the function of covering the micro-pump, but only activating it. It has a trigger hinged to a base element, which in turn is fastened to the ring nut of any pump of those commonly used at the time, the ring nut serving the purpose of applying the pump on a container of liquid to be nebulised, as well as covering said container. In particular, the device of U.S. Pat. No. 3,478,935 is constructed in a single piece of plastic material and it comprises an upper element and a lower element connected by a so-called virtual hinge obtained by means of thinning of the material that connects the upper element to the lower element. The upper element, including a trigger-shaped front portion, is provided superiorly with a cam portion able to act on the vertical activation pushbutton of the pump. The lower portion of the device is in a single piece with a cylindrical body for insertion by pressure on the aforesaid ring nut. The device of U.S. Pat. No. 3,478,935 lacks locking means to prevent the accidental activation of the trigger device and a safety seal that can prove that the device has been used and the liquid has been nebulised. European patent application No. 1 568 417 filed 18 Feb. 2005 by L'Oreal has, among its objects, that of providing a device for activating a pump push-button that can be adapted to every type of nebuliser pump with a greater ease of removal than provided by U.S. Pat. No. 3,478,935. The patent application by L'Oreal solves this problem with a device provided with a supporting ring having a portion for engaging the container, which portion extends only on a part of the periphery of the supporting ring. The device by L'Oreal is further provided with locking means against accidental activation in the form of a tab hinged in an inner part of the trigger and capable of serving as a sprag against a part of its same supporting ring to prevent the activation of the trigger.

Locking means against accidental activation during transport and shipment, similar to those described above, are provided in the nebuliser equipped with trigger described in the Japanese document No. 09-038540 published 10 Feb. 1997.

In this latter nebuliser an oscillating plate is hinged on a supporting ring and it is capable of going to abut against an inner part of the trigger provided with means to hold the oscillating plate, thereby preventing the activation of the trigger.

The aforementioned trigger locking means are not very reliable in assuring an effective locking, especially when the container is being handled. The locking tab or the oscillating plate, in a word the member that should prevent rotation, acts directly on the trigger itself and its stability and hence locking continuity are highly influenced by vibrations and oscillations of the trigger.

Moreover, neither in the device of the patent application No. 1 568 417, nor in the Japanese document No. 09-038540 are assurance means provided which could prove that the nebuliser micro-pump has actually been used.

DISCLOSURE OF INVENTION

Therefore, an object of the present invention is to prevent the accidental activation of a traditional nebuliser micro-pump, applied on a bottle containing liquid to be nebulised, a supplementary triggering device acting on the dispenser push-button of the micro-pump, complete with tube for orienting the spray, in order to transform the manner of activation of said micro-pump from vertical downwards to horizontal from the periphery towards the axis, thereby making it easier. Another object of the present invention is to provide a traditional nebuliser micro-pump equipped with trigger-like activation with an assurance seal, which can prove the eventuality of its use before the sale of the product within which it is incorporated.

The aforesaid objects are achieved by a nebuliser micro-pump provided with a trigger-like element for covering and activating its dispenser push-button, in which a micro-pump has an elongated body with central axis, whereon is mounted a dispenser push-button provided with means for connecting, on one side, with a bottle containing liquid to be nebulised and, on the other side, with a trigger-like covering and activation element, which is able to conceal the elongated body and to change the manner of activation of the micro-pump from that in which a force is applied according to the central axis from the top downwards on the dispenser push-button to that in which a radial force is applied towards the same central axis, the trigger-like covering and activating element comprising a fixed part, integral with the elongated body, and a part that is movable relative to the fixed part around a hinging axis that is substantially perpendicular relative to the central axis and offset in axis at the opposite part to the orienting tube, and provided with a protuberance acting on the dispensing push-button in the rotation of the movable part relative to the fixed part, micro-pump that, from a general viewpoint, is characterised in that the fixed and the movable parts of the covering and activating element have respective through openings wherefrom simultaneously projects the tube for orienting the spray, the tube being manually rotatable together with the dispensing push-button around the central axis of the elongated body in the openings between at least two angular positions:

a non operative position of the micro-pump, in which the tube for orienting the spray is closely delimited by the fixed and movable parts of the covering and activating element and hence it is made immovable at least in the direction of the central axis, and an operative position of the micro-pump, in which the tube (4) for orienting the spray is inside a slot which is elongated in the direction of the central axis, upwards in the movable part and respectively downwards in the fixed part of the covering and activating element, so that the orienting tube, together with the dispensing push-button, is movable downwards when the covering and activating element is operated manually.

Advantageously, according to the invention, the fixed part of the covering and activating element is constituted by a fixed lower half-shell constructed in a single piece with a hose portion connectable to the elongated micro-pump body, the fixed lower half-shell having a rear part that is ergonomically shaped to be gripped with the palm of the hand and a front part provided with a through opening for the tube for orienting the spray; and the movable part of the covering and activating element is constituted by an upper movable half-shell connected with hinge means around the hinging axis to the lower fixed half-shell, the upper movable half-shell having a rear part that is internally provided with a protuberance that is to bear on the dispensing push-button and a front part with arched, trigger-like shape, shaped ergonomically for gripping with the fingers of the hand and provided with a through opening for the spray-orienting tube; the lower fixed and upper movable half-shells having lateral walls that join the respective rear parts with the respective front parts, so dimensioned and shaped that the upper movable half-shell is able to close on the lower fixed half-shell covering it at least at the respective front parts.

Conveniently, the through opening in the front part of the lower fixed half-shell is frontally shaped as an inverted, upside down "L" and the through opening in the front part of the upper movable half-shell is frontally shaped as an inverted "L", the base of the opening "L" shape coinciding in the respective through openings when the orienting tube is positioned in their interior to the left for the non-operative position of the micro-pump and, respectively, to the right for the operative position of the micro-pump.

Advantageously, the through opening in the front part of the upper movable half shell is closed in the side of the inverted L shape by means of a removable tab serving as assurance seal.

The advantages of the invention consist of the ease of construction of the covering and activating element, which can be obtained by moulding a single piece.

Moreover, time saving is considerable, thanks to the fact that the element itself need not be subjected to assembling, naturally with the exception of mounting on the nebuliser micro-pump. Another advantage derives from the fact that the locking means to make the micro-pump non operative are further enhanced by the assurance seal, thereby reaching a high level of functional integration.

Moreover, the covering and activating element constructed in the manner of a shell makes it aesthetically pleasant, ergonomic and rugged, although with a reduced usage of material.

DESCRIPTION OF THE DRAWINGS

The advantage shall become more readily apparent from the detailed description that follows of an embodiment thereof, considered together with the accompanying drawing, in which.

DESCRIPTION OF THE ILLUSTRATIVE EMBODIMENT

Figure 1:
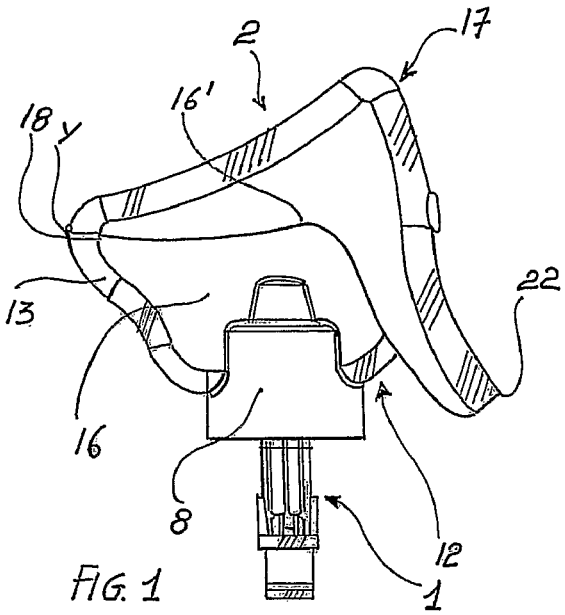
FIG. 1 is a lateral elevation view of a nebuliser micro-pump provided with an element for covering and triggering its dispensing button according to the invention.
Figure 2:
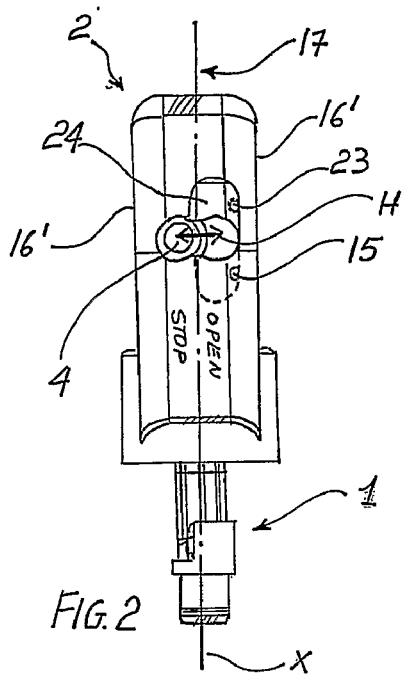
FIG. 2 is a front view of the nebuliser micro-pump with covering and triggering element of FIG. 1
Figure 3:
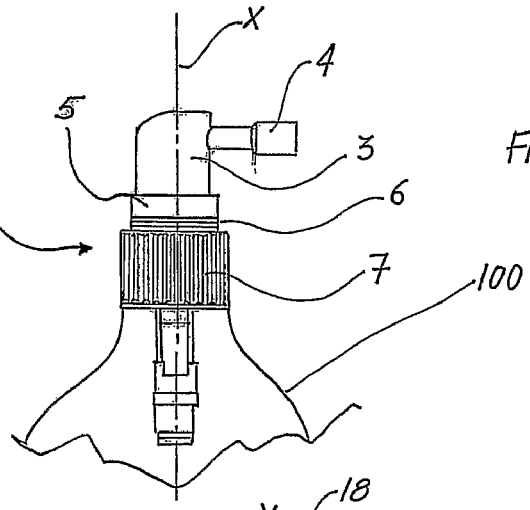
FIG. 3 is an enlarged lateral view of only the micro-pump applied in a bottle shown only partially.

With reference initially to FIGS. 1 and 2, a lateral and, respectively, a front view is provided of a nebuliser micro-pump provided with a covering and triggering element, globally designated with the numeral 2, according to the invention; In FIGS. 1 and 2, reference numbers are used to indicate parts that will be described with reference to subsequent figures. The arrangement of the micro-pump 1 is better shown in FIG. 3. Since it is a traditional micro-pump, it is not described in greater detail. For assembly purposes, in the micro-pump 1, from the top towards the bottom, a dispenser pushbutton 3 is observed, complete with tube 4 for precisely orienting the spray. The dispenser push-button 3 can be mounted removably on an elongated micro-pump body 5 having a central axis x. The elongated body 5 is provided peripherally with undercuts 6 for connection to the covering and triggering element 2 and with a ring nut 7 for fastening the micro-pump 1 to a bottle neck 100 shown only partially. The undercuts 6 and the ring nut 7 can be constructed differently from the way they are shown and they are to be generally construed as means for connecting the nebuliser micro-pump 1 with the element 2 for covering and triggering its dispenser push-button and with the bottle 100.

Figure 4:
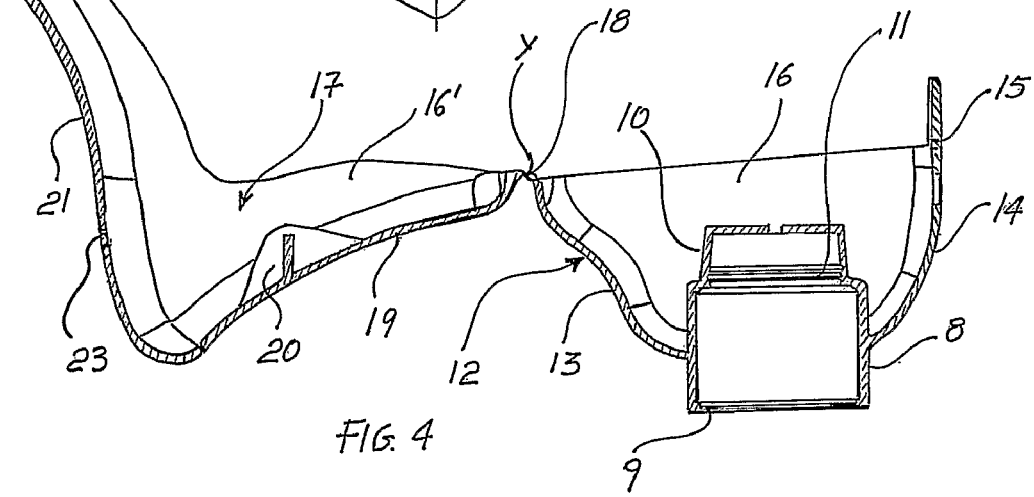
FIG. 4 is an enlarged central cross section of only the covering and triggering element of FIG. 1 shown in open condition.

With reference to FIG. 4, a central cross section of the element 2 for covering and triggering the dispenser push-button is shown. The covering and triggering element 2 comprises a fastening hose portion 8 to be applied on the ring nut 7 of the micro-pump 1. The hose portion 8, axial-symmetrical like the body 5 of the micro-pump 1, and provided inferiorly with an internal retaining projection 9 destined to be engaged under the lower end of the ring nut 7 of the body 5 of the micro-pump 1. The fastening hose portion 8 narrows superiorly in an upper part 10, which receives the dispenser push-button 3.

In the upper part 10 is provided a series of undercuts 11 such as to engage with the undercuts 6 of the ring nut of the micro-pump body 5 in the mounting therewith, the undercuts 11 being in origin constructed for the engagement of a push-button guard hood.

Around the fastening hose portion 8 of the covering and triggering element 2 and in a single piece therewith extends a lower fixed covering half-shell 12. The lower fixed covering half-shell 12 is contoured with a flattened shape with a part 13 constructed ergonomically to bear posteriorly against the palm of the user's hand. A front part 14 of the lower fixed half-shell 12 opposite the part 13 has an opening 15 for the tube 4. The opening 15 has an inverted "L" shape, i.e. as seen in a mirror and placed upside down, as shall be explained hereafter with reference to FIG. 2. Lateral walls 16, preferably constructed parallel, connect the rear part 13 with the front part 14 of the half-shell 12.

At the tope end of the lower fixed half-shell 12 is hinged a movable upper half-shell 17 of the covering and triggering element 2. The hinge between the lower fixed half-shell 12 and the upper movable half-shell 17 is designated by the numeral 18: it can be embodied with a hinge element or, advantageously, obtained in a single piece with a thinning of the material of the covering and triggering element 2 in that point. The upper movable half-shell 17 is dimensioned and shaped to partially cover the lower fixed half-shell 12 of the element 2, sliding downwards relative to the lateral walls of the fixed half-shell 12. For the purposes of the invention, as shall be readily apparent hereafter, at least a partial superposition of the front part of the movable half-shell relative to the front part of the fixed half-shell is necessary. As shown in FIG.

Figure 5:
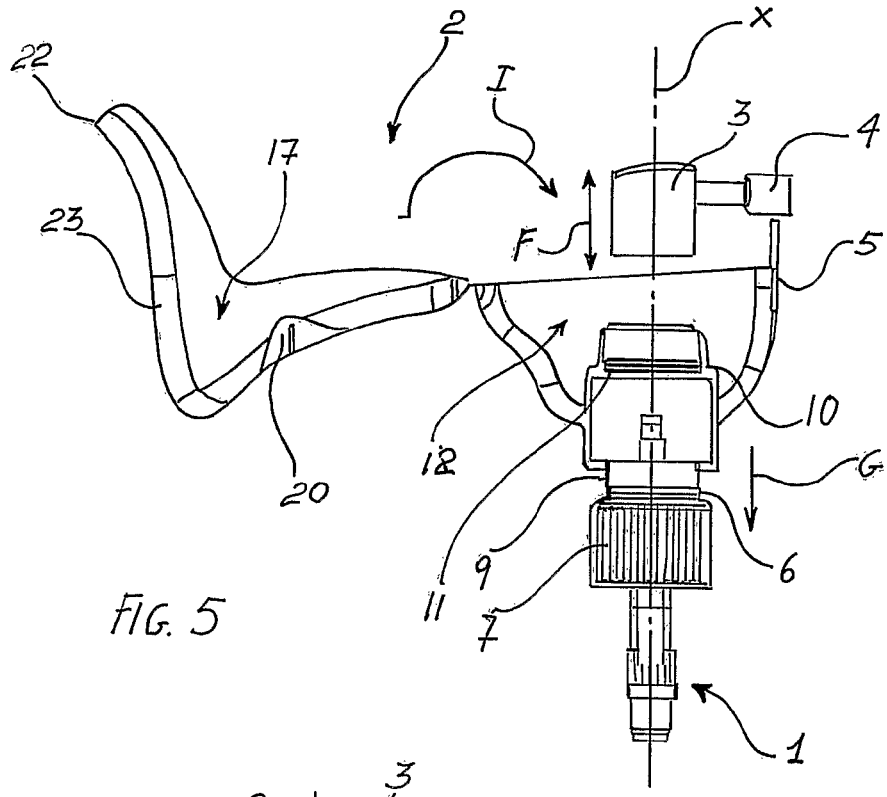
FIG. 5 is a cross section of only the covering and triggering element of FIG. 4 in open condition, whilst it is being mounted on the nebuliser micro-pump of FIG. 3.
Figure 6:
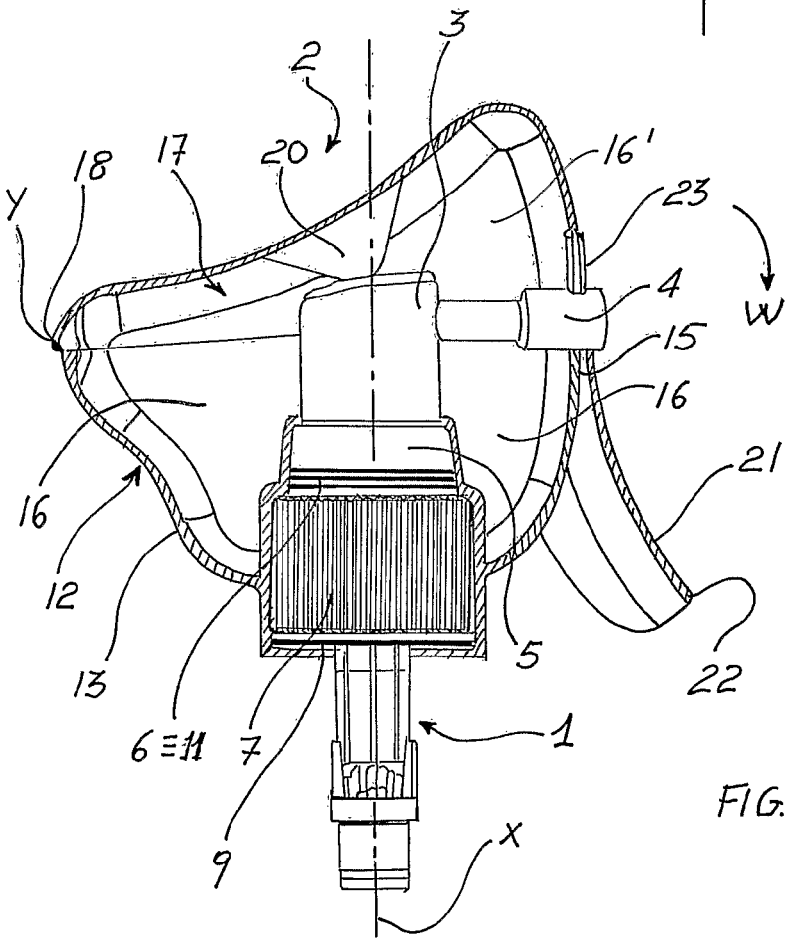
FIG. 6 is an enlarged cross section of the micro-pump of FIG. 1, the section being obtained in the covering and triggering element alone.

2, the lateral edges of the upper movable half-shell 17 (as well as those of the lower fixed half-shell 12) are rounded and this is highlighted, in the sections of FIGS. 4, 5 and 6, by the line (not designated by a reference numeral) that in parallel follows the profile of both half-shells 12, 17. Also shown are stiffening ribs, as well as particular shapes able to strengthen the half-shells. The upper movable half-shell 17 has a rear part 19 that in the rotation of the movable half-shell 17 towards the lower fixed half-shell 12 superposes on the rear part 13 in such a way as to form a closed shell. This is useful from the aesthetic viewpoint to conceal the micro-pump. In an appropriate position 5 of the rear part 19 a protuberance 20 projects inwards; said protuberance 20 serves as a cam for the dispenser push-button 3 of the micro-pump 1. The upper movable half-shell 17 has an arc shaped front part 21 extending forward to form a trigger terminating in an end 22 opposite to the rear part 13 of the lower half-shell serving as a grip.

The front part 21, too, is provided with an opening 23 with an inverted "L" shape, for the passage of the dispensing tube 4, and its function shall become readily apparent hereafter. The upper movable half-shell has parallel lateral walls 16', 16' to cover at least partially the walls 16, 16 of the lower fixed half-shell.

With reference to FIG. 5, the step of mounting the covering and triggering element 2 on the micro-pump 1 is shown. It is clearly visible that the element 2 is inserted with its fastening hose portion 8 positioned coaxially to the body 5 of the micro-pump 1 according to the central axis x. Previously, the removable assembly of dispenser push-button 3 and spray-orienting tube 4 was removed from the micro-pump 1 and then reinstalled according to the two-headed arrow F, which is to be construed to coincide with the central axis x of the micro-pump 1. The fastening hose portion 8 is sent on the ring nut 7 of the micro-pump 1 according to the arrow G, which also coincides with the central axis x, until the internal retaining projection 9 engages the lower edge of the ring nut 7. The dispenser push-button 3, complete with tube 4, is applied on the nebuliser micro-pump (1) through the hole obtained in the upper end of the cone frustum 10 part of the fastening hose portion 8 of the element 2 and hence of the micro-pump 1. The tube 4 is inserted into the opening 15 obtained in the front part 14 of the lower half-shell 12. At this point it is possible to rotate the upper half-shell 17 according to the arrow I clockwise, inserting its opening 23 on the tube 4. The final mounting position is the one shown in FIG. 6, which is an enlarged cross section of the micro-pump, obtained in the covering and triggering element alone. FIG. 6 shows that in the closing of the movable half-shell its internal protuberance 20 goes to bear on the dispensing push-button 3 whilst its orienting tube passes through both the lower half-shell 12 and the upper half-shell 17 thanks to the respective through openings 15 and 23. The two half-shells 12 and 17 and their hinge 18 with hinging axis y, perpendicular to the central axis x and offset relative thereto at the opposite side from the tube 4, are so arranged that the shell formed by the two half-shells 12 and 17 has a stable condition when completely open or undergoing assembly as shown in FIGS. 4 and 5 and also a stable condition when closed or in operation as shown in FIGS. 1, 2 and 6.

FIG. 2 shows the relative position of the spray orienting tube 4 relative to the through openings 15 and 23. The opening 15 of the lower half-shall has an inverted, upside down "L" shape; its horizontal part or base of the L coincides with the horizontal part of the opening 23 of the upper half-shell, whilst its lower part or side of the L extends downwards in the direction of the central axis x, and it is shown with a dashed line because it is covered by the upper half-shell 17. The opening 23 of the upper half-shall has an inverted "L" shape, as stated previously; its horizontal part or base of the L coincides with the horizontal part of the opening 15 of the lower half-shell, whilst its upper part or side of the L extends upwards in the direction of the central axis x. The orienting tube 4 can be rotated with the dispensing push-button 3 around the central axis x of the micro-pump relative to the covering and triggering element 2 with the effect that said tube can be moved according to the two-headed arrow H in two angular position, one to the left, looking at the front of the micro-pump as shown in FIG. 2, marked as STOP and the other one to the right, marked as OPEN. When the tube 4 is in the STOP position, the upper movable half-shell 17 cannot move relative to the lower fixed half-shell 12, because the tube 4 simultaneously occupies the left end of the inverted, upside down "L" shaped opening 15 of the lower half-shell 12 and the left end of the inverted "L" shaped opening 23 of the upper half-shell 17. Hence, the upper movable half-shell 17 cannot rotate further according to the arrow W around the hinging axis y (FIG. 6) to press the dispensing push-button 3 with the protuberance 20. Thus, when the tube 4 is in the STOP position, the nebuliser micro-pump cannot dispense. On the contrary, when the tube 4 is in the OPEN position, the upper movable half-shell 17 can be moved relative to the lower fixed half-shell 12, because the opening 23 of the upper half-shell enables the latter to slide downwards at the side of the tube 4. Then, pressing on the end trigger 22, the upper half-shell 17 moves downwards, being able to rotate according to the arrow W to press the dispensing push-button 3 with the protuberance 20. The vertical side of the upside down, inverted "L" shaped opening 15, directed downwards in the direction of the central axis x, is necessary to allow the lowering travel undergone by the tube 4 as a result of the pressing of the push-button 3 downwards.

According to the present invention, in the same upper half-shell 17 can be provided an assurance seal to prove any fraudulent use. The assurance seal may consist of a removable tab 24 that closes the upper vertical portion of the inverted "L" opening 23 in the upper half-shell.

The removable tab 24 could extend over the entire side of the "L" shaped opening, directed according to the axis x. In this way, a locking and opening disposition of the micro-pump 1 is obtained through the interaction of the tube 4 for orienting the spray with the fixed and movable half-shells 12, 17 of the covering and triggering element 2 through the respective front openings 15, 23. In this locking and opening disposition is also incorporated the assurance seal function with the removable tab 24 able to prevent the displacement of the upper half-shell relative to the fixed one. It should be understood that the type of connection of the covering and triggering element with the micro-pump may also be different from the one described and illustrated above. In fact, the covering and triggering element itself can be provided with adapting means that enable its application on micro-pumps with different shapes and dimensions.

Therefore, variations and modifications can be made to the embodiment described above, without departing from the scope of the invention as defined in the appended claims.

The invention claimed is:

1. A nebuliser micro-pump provided with an element for covering and triggering its dispensing push-button, in which a micro-pump (1) has an elongated body (5) with central axis (x), whereon is mounted a dispensing push-button (3) complete with a tube (4) for orienting the spray, said elongated body (5) being provided with means for connecting, on one side, with a bottle (100) containing liquid to be nebulised and, on the other side, with a trigger-like covering and activation element (2), which is able to conceal the elongated body (5)

and to change the manner of activation of the micro-pump from that in which a force is applied according to the central axis (x) from the top downwards on the dispenser push-button (3) to that in which a radial force is applied towards the same central axis (x), said trigger-like covering and activating element comprising a fixed part, integral with said elongated body (5), and a part that is movable relative to the fixed part around a hinging axis (y) that is substantially perpendicular relative to the central axis (x) and offset in axis at the opposite part to the orienting tube, and provided with a protuberance acting on said dispensing push-button (3) in the rotation of the movable part relative to the fixed part, characterised in that said fixed and movable parts of the covering and activating element (2) have respective through openings (15, 23) wherefrom simultaneously projects said tube (4) for orienting the spray, said tube being manually rotatable together with the dispensing push-button (3) around said central axis (x) of the elongated body (5) in the openings between at least two angular positions:

a non operative position, in which the tube (4) for orienting the spray is delimited closely by said fixed and movable parts of said covering and activating element (2) and hence is made immovable at least in the direction of the central axis (x), and —an operative position of the micro-pump, in which the tube (4) for orienting the spray is within a slot that is elongated in the direction of the central axis (x), upwards in the movable part and respectively downwards in the fixed part of said covering and activating element (2), so that the orienting tube (4), together with the dispensing push-button (3) is movable downwards when said covering and activating element (2) is operated manually.

2. Nebuliser micro-pump as claimed in claim 1, characterised in that:

the fixed part of the covering and activating element is constituted by a lower fixed half-shell constructed in a single piece with a hose portion connectable to the elongated micro-pump body, the lower fixed half-shell having a rear part that is ergonomically shaped to be gripped with the palm of the hand and a front part provided with a through opening for the tube for orienting the spray; and —said movable part (2) of the covering and activating element is constituted by an upper movable half-shell (17) connected with hinge means (18) around the hinging axis (y) to the lower fixed half-shell (12), said upper movable half-shell (17) having a rear part (19) that is internally provided with a protuberance (20) that is to bear on said dispensing push-button (3) and a front part (21) with arched, trigger-like shape, shaped ergonomically for gripping with the fingers of the hand and provided with a through opening (23) for said spray-orienting tube (4); said lower fixed and upper movable half-shells (12, 17) having lateral walls (16, 16 and 16', 16') that join the respective rear parts (13, 19) with the respective front parts (14, 21), so dimensioned and shaped that the upper movable half-shell (17) is able to close on the lower fixed half-shell (12) covering it at least at the respective front parts (14, 2).

3. Nebuliser micro-pump as claimed in claim 2, characterised in that said through opening (15) in the front part (14) of the lower fixed half-shell (12) is frontally shaped as an inverted, upside down "L" and said through opening (23) in the front part (21) of the upper movable half-shell (17) is frontally shaped as an inverted "L", the base of the opening "L" shape coinciding in the respective through openings (15, 23) when the orienting tube (4) is positioned in their interior to the left for the non-operative position of the micro-pump and, respectively, to the right for the operative position of the micro-pump.

4. Nebuliser micro-pump as claimed in claim 3, characterised in that said through opening (23) in the front part (21) of the upper movable half-shell (17) is closed in the side of the inverted "L" shape by means of a removable tab (24) serving as an assurance seal.

5. Nebuliser micro-pump as claimed in claim 4, characterised in that said through opening (23) in the front part (21) of the upper movable half-shell (17) is closed in the side of the inverted "L" shape by means of a removable tab (24), which extends in said "L" shaped base.

6. Nebuliser micro-pump as claimed in claim 1, characterised in that said hinge means (18) are obtained by means of a thinning of the material that constitutes the connection between said fixed part and said movable part, in such a way as to have two stable equilibrium conditions, an open or assembly condition and a closed or operating condition.

* * * * *